US008460164B2

(12) United States Patent
Sullivan

(10) Patent No.: US 8,460,164 B2
(45) Date of Patent: Jun. 11, 2013

(54) EXERCISE APPARATUS AND METHOD OF USE

(76) Inventor: John Darrell Sullivan, Chesterton, IN (US)

( * ) Notice: Subject to any disclaimer, the term of this patent is extended or adjusted under 35 U.S.C. 154(b) by 270 days.

(21) Appl. No.: 13/151,379

(22) Filed: Jun. 2, 2011

(65) Prior Publication Data

US 2011/0300998 A1 Dec. 8, 2011

Related U.S. Application Data

(60) Provisional application No. 61/350,533, filed on Jun. 2, 2011.

(51) Int. Cl.
*A63B 21/06* (2006.01)

(52) U.S. Cl.
USPC ..... 482/94; 482/104

(58) Field of Classification Search
USPC ..... 482/92–94, 104, 105–108; D21/662, D21/679, 680, 682, 686, 690, 691
See application file for complete search history.

(56) References Cited

U.S. PATENT DOCUMENTS

| | | | |
|---|---|---|---|
| 254,215 | A | 2/1882 | Heeseler |
| 1,286,151 | A | 11/1918 | Tothill |
| 1,495,536 | A | 5/1924 | Smith |
| 2,470,815 | A | 5/1949 | Harvey |
| 2,932,510 | A | 4/1960 | Kravitz |
| 3,117,760 | A | 1/1964 | Dresbach et al. |
| 3,524,644 | A | 8/1970 | Kane |
| 4,360,198 | A | 11/1982 | Waulters |
| 4,369,968 | A | 1/1983 | Price |
| D290,033 | S | 5/1987 | Policastro |
| 4,799,674 | A | 1/1989 | Ochab |
| 4,858,917 | A | 8/1989 | Montgomery |
| 5,152,732 | A | 10/1992 | Sayre |
| 5,257,964 | A | 11/1993 | Petters |
| 5,277,676 | A | 1/1994 | Holland et al. |
| D356,351 | S | 3/1995 | Watts |
| 5,468,203 | A | 11/1995 | Okonkwo |
| 5,538,487 | A | 7/1996 | Fulmer |
| 5,582,565 | A | 12/1996 | Soria |
| 5,662,556 | A | 9/1997 | Gangloff |
| 5,984,843 | A | 11/1999 | Morton |
| 6,715,728 | B2 | 4/2004 | Nielsen |
| 7,662,067 | B2 | 2/2010 | Payne |
| D617,400 | S | 6/2010 | Hetzel et al. |
| 2005/0209054 | A1 | 9/2005 | Lebert |
| 2006/0100075 | A1 | 5/2006 | Harsh |
| 2010/0041531 | A1 | 2/2010 | Rochford |

*Primary Examiner* — Loan Thanh
*Assistant Examiner* — Nyca T Nguyen
(74) *Attorney, Agent, or Firm* — Hartman Global IP Law; Gary M. Hartman; Domenica N.S. Hartman

(57) ABSTRACT

An exercise apparatus configured to be readily stowed and transported. The apparatus includes a lifting bar and a pair of frames. Each of the frames includes a support member and base. Each support member has a distal end opposite its base and a series of adjustment holes therethrough for receiving one end of the lifting bar. The support member of one frame has a cavity that is sufficiently large to slidably receive the support member of the other frame. Each base has a stowage hole adapted to receive one end of the lifting bar. The apparatus includes fasteners by which the ends of the lifting bar can be secured within a pair of the adjustment holes in the support members to define a deployed configuration of the apparatus, as well as secured within the stowage holes in the bases to define a stowed configuration.

20 Claims, 3 Drawing Sheets

EXERCISE APPARATUS AND METHOD OF USE

CROSS REFERENCE TO RELATED APPLICATIONS

This application claims the benefit of U.S. Provisional Application No. 61/350,533, filed Jun. 2, 2010, the contents of which are incorporated herein by reference.

BACKGROUND OF THE INVENTION

The present invention generally relates to exercise equipment and routines, and more particularly to a versatile exercise apparatus adapted for use in weightlifting exercises and configured to be readily portable and stowable.

Exercise equipment adapted for weightlifting typically have some type of lifting bar to which weights can be added and removed to adjust the amount of weight lifted by the user. To promote their safety, weightlifting equipment have also been proposed that incorporate a lifting bar coupled to a stable support frame so that the bar and frame are both lifted by the user during exercising. An example is U.S. Pat. No. 4,360,198 to Waulters, which discloses an exercise apparatus that includes a lifting bar coupled to standards of a supporting frame. During use, the bar and supporting frame are lifted together by the user. The standards provide an adjustment capability so that the vertical height of the bar can be adjusted to allow various different exercises to be performed with the apparatus.

Weight lifting equipment are often large and bulky. To facilitate their transport and storage, weightlifting equipment have been proposed that enable the components to be disassembled and stowed to achieve a more compact outline. An example can be found in U.S. Pat. No. 5,662,556 to Gangloff.

BRIEF DESCRIPTION OF THE INVENTION

The present invention provides an exercise apparatus that includes frames that are adapted to adjustably support a lifting bar in a manner that promotes the versatility and safety aspects of the apparatus, while also being configured to be readily stowable and portable.

According to a first aspect of the invention, the exercise apparatus includes a lifting bar and first and second frames. The lifting bar has oppositely-disposed ends and a gripping portion therebetween. Each of the first and second frames comprises a support member and a base adapted to support the support member in a vertical orientation when the base is on a horizontal surface. Each of the support members has a distal end opposite the base thereof and a series of adjustment holes therethrough that are sufficiently large to receive one of the ends of the lifting bar. The support member of the first frame has a cavity that is sufficiently large to slidably receive at least a portion of the support member of the second frame, and further has an opening in the distal end thereof through which the support member of the second frame can enter the cavity. Each of the bases of the first and second frames has at least one stowage hole therethrough that is sufficiently large to receive one of the ends of the lifting bar. The apparatus further comprises means for securing the ends of the lifting bar within a pair of the adjustment holes of the support members while the gripping portion of the lifting bar is between the support members. The first and second frames and the lifting bar are assemblable to define a deployed configuration of the exercise apparatus, in which the support members of the first and second frames are parallel to each other, the ends of the lifting bar are received within a pair of the adjustment holes of the support members, the gripping portion of the lifting bar is between the support members, and the securing means retain the lifting bar within the pair of the adjustment holes. In addition, the first and second frames and the lifting bar are assemblable to define a stowed configuration of the exercise apparatus, in which the support member of the second frame is slidably received in the support member of the first frame to define a stowed axis of the exercise apparatus, the stowage holes in the bases of the first and second frames are aligned along an axis parallel to the stowed axis, the ends of the lifting bar are received within the stowage holes in the bases, and the securing means simultaneously retain the lifting bar on the bases and the support member of the second frame within the support member of the first frame.

According to another aspect of the invention, the exercise apparatus can form part of a package when in the stowed configuration, in which the support member of the second frame is at least partially received in the support member of the first frame, the stowage holes in the bases of the first and second frames are aligned along the axis parallel to the stowed axis, the ends of the lifting bar are received within the stowage holes, and the securing means simultaneously retain the lifting bar on the bases and the support member of the second frame within the support member of the first frame.

Still other aspects of the invention include methods of stowing an exercise apparatus, including but not limited to the apparatus comprising the elements described above. As an example, such a method includes inserting the distal end of the support member of the second frame through the opening in the distal end of the support member of the first frame until at least a portion of the support member of the second frame is slidably received in the cavity within the support member of the first frame, and so that stowage holes in the bases of the first and second frames are co-axially aligned. The lifting bar is then placed between the bases of the first and second frames, the ends of the lifting bar are inserted through the stowage holes of the bases, and the ends of the lifting bar are secured within the stowage holes.

Advantages of the exercise apparatus and methods described above include the ability of the apparatus to provide a range of adjustments for the lifting bar in a manner that promotes the versatility of the apparatus, yet also the ability to readily stow the apparatus in a manner that facilitates transportation of the apparatus.

Other aspects and advantages of this invention will be better appreciated from the following detailed description.

DETAILED DESCRIPTION OF THE INVENTION

Figure 1:
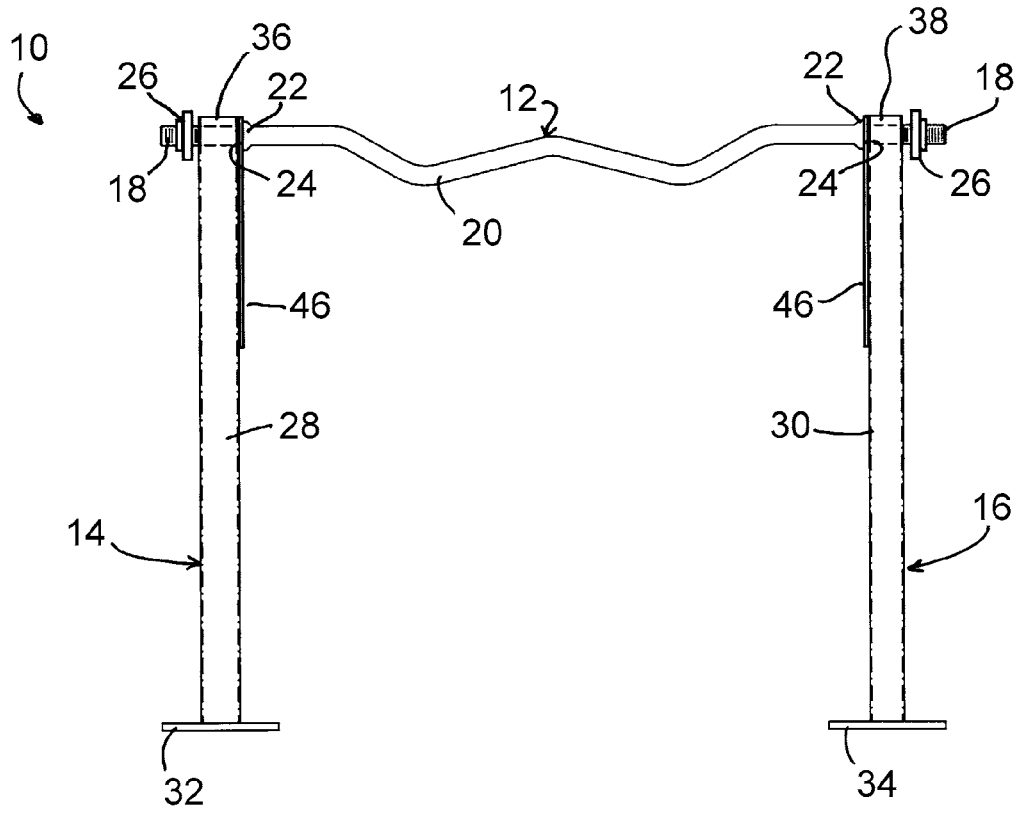
FIG. 1 is a front view showing an exercise apparatus in a deployed configuration in accordance with a preferred embodiment of this invention.
Figure 2:
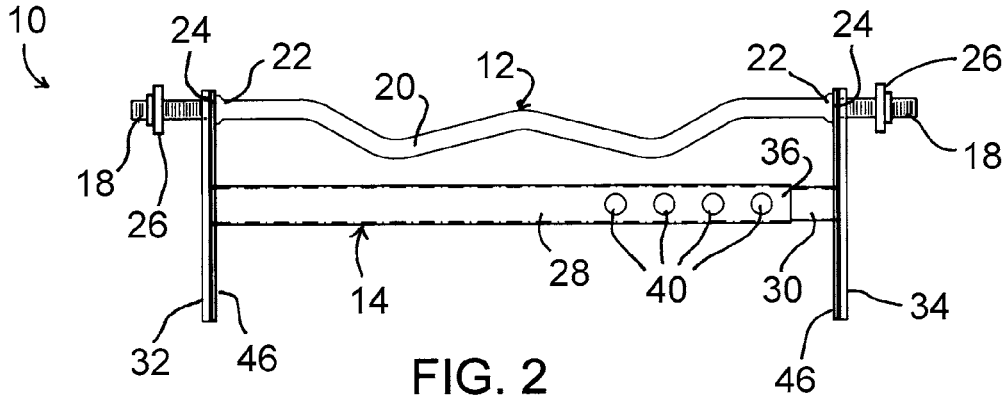
FIG. 2 is a front view showing the exercise apparatus of FIG. 1 in a stowed configuration in accordance with the preferred embodiment of this invention.

FIGS. 1 and 2 represent, respectively, deployed and stowed configurations of an exercise apparatus 10 in accordance with a preferred embodiment of the invention. As evident from FIGS. 1 and 2, the apparatus 10 is adapted to be a portable and integrated unit that is capable of a wide variety of uses. According to preferred aspects of the invention, the apparatus 10 can be used to help develop back and core strength, while also being used for overall strength training and conditioning. A particular aspect of the invention is the ability of the apparatus 10 to be used as an effective training tool in both a fully deployed configuration (FIG. 1) as well as a stowed configuration (FIG. 2). The deployed configuration is particularly effective for strengthening muscle groups that have been previously difficult to develop.

From the following, it will become evident that, in both its deployed and stowed configurations, components of the apparatus 10 can be securely assembled into a single unit, helping to ensure that the apparatus 10 can be safely used and transported, as well as reduce the risk of components being misplaced.

Figure 3:
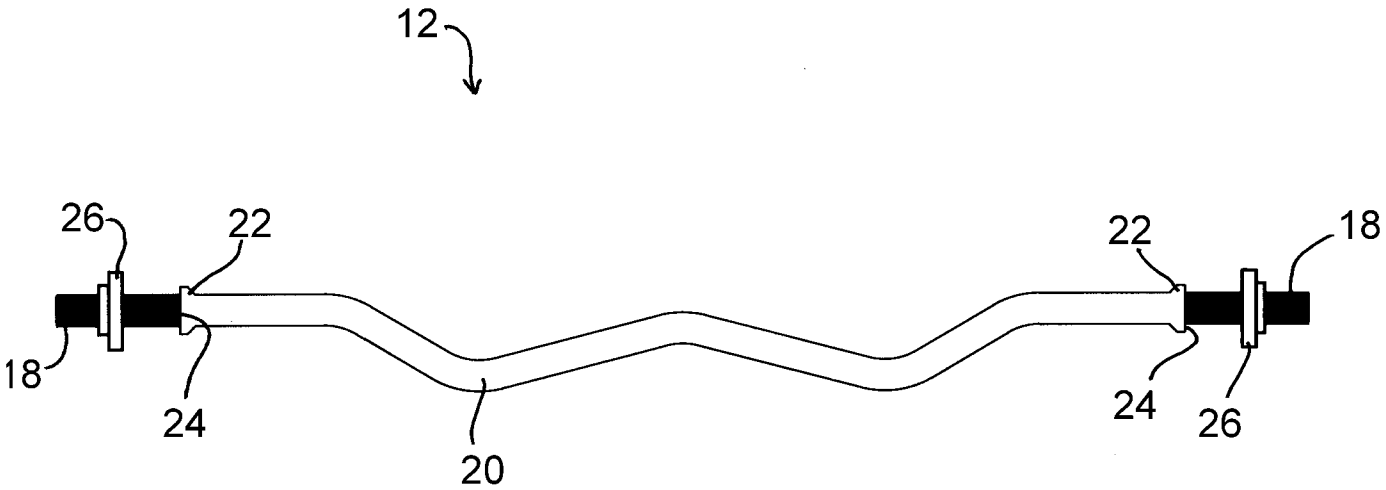
FIG. 3 represents an isolated front view of a lifting bar of the apparatus of FIGS. 1 and 2.
Figure 4:
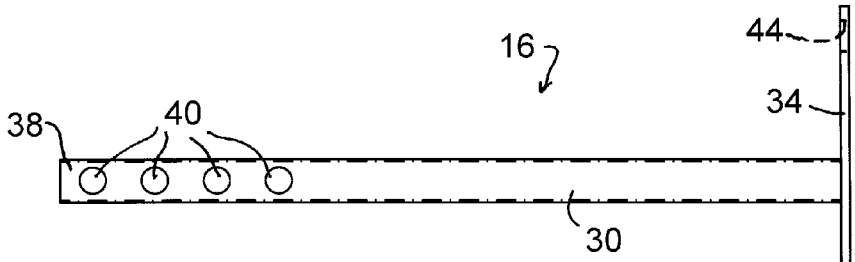
FIGS. 4 and 5 represent isolated side views of two frames of the apparatus of FIGS. 1 and 2.
Figure 5:
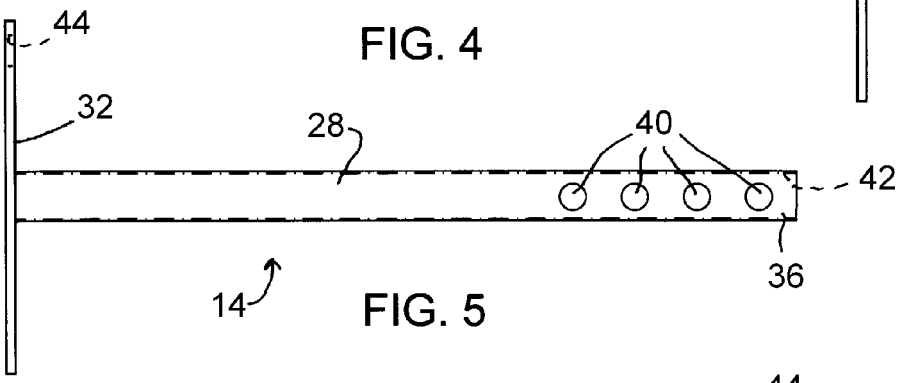
Figure 6:
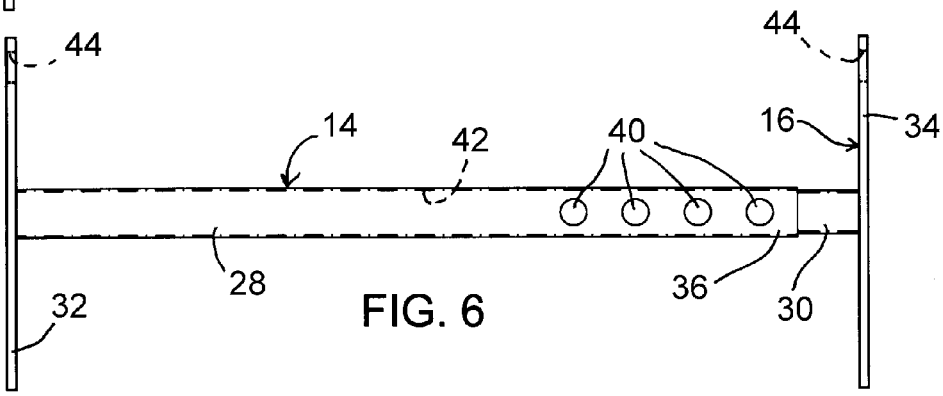
FIG. 6 shows the two frames of FIGS. 4 and 5 assembled together, in which one of the frames in nested within the other frame in accordance with a preferred aspect of this invention.
Figure 7:
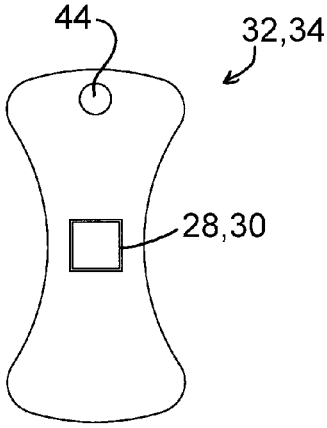
FIG. 7 is an end view of one of the frames of FIGS. 4 and 5.

In FIGS. 1 and 2, the exercise apparatus 10 can be seen to include a lifting bar 12 and a pair of frames 14 and 16. As evident from FIGS. 1 and 2 and as further shown in FIG. 3, the bar 12 has oppositely-disposed ends 18 between which a gripping portion 20 is defined. The gripping portion 20 can be configured as shown in FIGS. 1, 2 and 3, or have a variety of other shapes including a simple linear shape. The gripping portion 20 defines two flared portions 22 that provide abutment surfaces 24, against which support members 28 and 30 of the frames 14 and 16 abut. The ends 18 of the bar 12 are preferably threaded to have male threads that allow fasteners 26 with complementary female threads to be threaded onto the bar 12. By threading the fasteners 26 onto the ends 18 of the bar 12, the support members 28 and 30 can be clamped against the abutment surfaces 24 of the bar 12 to secure and stabilize the bar 12 between the support members 28 and 30. While the complementary threaded features of the bar 12 and fasteners 26 provide a convenient method for securing and clamping the bar 12 and frames 14 and 16 together, it is foreseeable that other types of securing and/or clamping means could be used instead of or in addition to the threaded features, for example, quick-release devices, pins, clamps, etc., and all such means are within the scope of the invention.

In addition to the support members 28 and 30, the frames 14 and 16 each comprise a base 32 and 34, respectively, adapted to maintain its corresponding support member 28 or 30 in a vertical orientation when the base 32 or 34 is resting on a horizontal surface. Each support member 28 and 30 has a distal end 36 and 38 opposite its base 32 and 34. As best seen in FIGS. 2 through 6, a series of adjustment holes 40 are defined in each of the support members 28 and 30 adjacent their distal ends 36 and 38, through which one end 18 of the bar 12 is able to be received, as evident from in FIG. 1. The numbers, locations and spacing of the adjustment holes 40 allow for the lifting bar 12 to be supported with the frames 14 and 16 at adjustable distances from the bases 32 and 34 and, therefore, a surface supporting the bases 32 and 34. The available distances can be selected to adjust for the height and/or arm length of the user when using the apparatus 10 for various different exercises. For this purpose, a nonlimiting example of a suitable center-to-center spacing for the holes 40 is about 2.5 inches (about 6.5 cm). It should be apparent that the numbers, locations and spacing of the adjustment holes 40 can vary from that shown in FIGS. 2 and 4 through 6.

The bar 12 and frames 14 and 16 can be manufactured from a variety of materials to have a wide range of dimensions. As nonlimiting examples, the bar 12 can have a length of about forty inches (about 100 cm), each support member 14 and 16 can have a length of about thirty inches (about 75 cm), and the bases 32 and 34 can have widths (as seen in FIG. 1) of about six inches (about 15 cm) and lengths (as seen in FIG. 2) of about twelve inches (about 30 cm). The relatively greater lengths of the bases 32 and 34 promote the forward-rearward stability of the apparatus 10 (as viewed in FIG. 1) when deployed and in use. The bar 12 and frames 14 and 16 can be coated with a rubber-type coating to reduce slippage between the bases 32 and 34 and a supporting surface, protect the surfaces of the bar 12 and frames 14 and 16, improve aesthetics, etc.

To achieve the stowed configuration for the exercise apparatus 10 represented in FIG. 2, the support member 28 of the frame 14 (shown in an isolated view in FIG. 5) is hollow to define a cavity 42 (FIG. 5) that is sufficiently large to slidably receive at least a portion and preferably the entire support member 30 of the other frame 16 (shown in an isolated view in FIG. 4) through an opening defined by the cavity 42 in the distal end 36 of the support member 28. For this reason, at least the support member 28 is preferably configured as a hollow post, and its cavity 42 preferably has a cross-sectional shape corresponding to the outer cross-sectional shape of the support member 30, for example, rectilinear. A suitable but nonlimiting outer dimension for the support member 28 is about two inches (about 5 cm), and a suitable but nonlimiting width for the cavity 42 of the support member 28 and outer dimension for the support member 30 is about 1.75 inches (about 4.5 cm), with an allowance for sufficient clearance between the two to allow the support member 30 to freely slide within the cavity 42 of the support member 28. The cross-sections of the support members 28 and 28 provide multiple contact points for the bar 12, which further promotes the stability of the apparatus 10.

As evident from FIGS. 4 through 7, each base 32 and 34 of the frames 14 and 16 has at least one stowage hole 44 therethrough that is sufficiently large to receive one end 18 of the lifting bar 12 in the manner represented in FIG. 2. As seen by comparing FIGS. 2 and 6, the stowage holes 44 permit the bar 12 to be positioned and clamped between the bases 32 and 34 through the action of the fasteners 26 on the threaded ends 18 of the bar 12.

On the basis of the above, the lifting bar 12 and frames 14 and 16 are assemblable to define the deployed configuration of the exercise apparatus 10, as seen in FIG. 1. In particular, the support members 28 and 30 of the frames 14 and 16 are parallel to each other, the ends 18 of the lifting bar 12 are received within a coaxially-aligned pair of the adjustment holes 40 in the support members 28 and 30, and the fasteners 26 retain the lifting bar 12 within the pair of the adjustment holes 40. As evident from FIG. 1, the frames 14 and 16 are interconnected solely through the lifting bar 12 when the apparatus 10 is in its deployed configuration.

The lifting bar 12 and frames 14 and 16 are also assemblable to define the stowed configuration for the exercise apparatus 10, as seen in FIG. 2. In particular, the support member 30 of one frame 16 is slidably received in the support member 28 of the other frame 14, to define what may be referred to as a stowed axis of the apparatus 10. The stowage holes 44 in the bases 32 and 34 of the frames 14 and 16 are aligned along an axis parallel to the stowed axis, the ends 18 of the lifting bar 12 are received within the stowage holes 44, and the fasteners 26 simultaneously retain the lifting bar 12 on the bases 32 and 34 and the support member 30 within the larger support member 28. The result is a compact stowed configuration well suited to be sold as a package, for example, by encasing all or part of the stowed apparatus 10 in any desired type of packaging materials (not shown).

The apparatus 10 can be readily reconfigured from the deployed configuration of FIG. 1 to the stowed configuration of FIG. 2 by removing the fasteners 26, and then removing the ends 18 of the bar 12 from the adjustment holes 40 in the support members 28 and 30. Thereafter, the distal end 38 of the support member 30 can be inserted into the cavity 42 within the other support member 28 until a portion of the support member 30 is slidably received within the cavity 42, and so that the stowage holes 44 in the bases 32 and 34 are co-axially aligned. The lifting bar 12 can then be placed between the bases 32 and 34, and the support member 30 can be further inserted into the cavity 42 of the other support member 28 to cause the ends 18 of the lifting bar 12 to pass through the stowage holes 44 of the bases 32 and 34, at which point the ends 18 of the lifting bar 12 can be secured within the stowage holes 44 using the fasteners 26.

Figure 8:
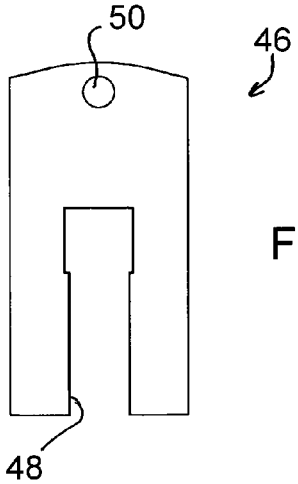
FIG. 8 is an end view of a weight shown in FIGS. 1 and 2.

FIGS. 1 and 2 further represent a set of weights 46 as being mounted to the support members 28 and 30 of the frames 14 and 16. One of the weights 46 is shown in isolation in FIG. 8 to have a slot 48, which is sized to receive the entire cross-section of the support member 28 to permit the removable mounting of the weights 46 on the support member 28 as represented in FIG. 2. Each weight 46 also has a through-hole 50 that is sufficiently large to receive one end 18 of the lifting bar 12. As a result, with the exercise apparatus 10 in its deployed configuration shown in FIG. 1, multiple weights 46 can be mounted to the lifting bar 12 by inserting the ends 18 of the bar 12 through the through-holes 50 of the weights 46 prior to the ends 18 being inserted into the adjustment holes 40 of the support members 28 and 30. The weights 46 are then firmly secured by the clamping action generated between the fastener 26 and the adjacent abutment surface 24 of the bar 12. For the stowed configuration shown in FIG. 2, multiple weights 46 can be mounted on the support member 28 so that their through-holes 50 are coaxially aligned with the stowage holes 44 of the bases 32 and 32 and the ends 18 of the lifting bar 12 are simultaneously received within the stowage holes 44 and through-holes 50. Each of any number of weights 46 is then firmly secured by a combination of having one end 18 of the lifting bar 12 within its through-hole 50, the support member 28 within its slot 48, and the clamping action generated between the fastener 26 and the adjacent abutment surface 24 of the bar 12.

With the inclusion of the weights 46, the process of reconfiguring the apparatus 10 from its deployed configuration of FIG. 1 to its stowed configuration of FIG. 2 is slightly modified by removably mounting the weights 46 on the support member 28 after the support member 30 has been at least partially inserted into the cavity 42 of the support member 28. The weights 46 are mounted so that their through-holes 50 are coaxially aligned with the stowage holes 44 of the bases 32 and 34, after which the ends 18 of the lifting bar 12 are also inserted through the through-holes 50 in the weights 46 prior to securing the ends 18 of the bar 12 with the fasteners 26.

In the deployed configuration, the apparatus 10 can be employed in a wide variety of exercises, for example, such non-standing exercises as prone or horizontal pull-ups and chin-ups, as well as such standing exercises as squats, dips, calf raises, curls, overhead triceps, shoulder press, and upright rowing. Various standing exercises can also be performed with the apparatus 10 in its stowed configuration. Notably, from FIGS. 1 and 2 it should be apparent that additional weights 46 can be easily added to the apparatus 10 for use of the apparatus 10 in both its deployed and stowed configurations.

While the invention has been described in terms of a specific embodiment, it is apparent that other forms could be adopted by one skilled in the art. For example, the individual components of the apparatus 10 can be shaped, constructed or otherwise configured to result in a different appearance than what is shown in the drawings, yet still provide the various aspects of the invention described above. Therefore, the scope of the invention is to be limited only by the following claims.

The invention claimed is:

1. An exercise apparatus comprising:

a lifting bar having oppositely-disposed ends and a gripping portion therebetween;

first and second frames, each of the first and second frames comprising a support member and a base adapted to support the support member in a vertical orientation when the base is on a horizontal surface, each of the support members having a distal end opposite the base thereof and a series of adjustment holes therethrough that are sufficiently large to receive one of the ends of the lifting bar, the support member of the first frame having a cavity that is sufficiently large to slidably receive at least a portion of the support member of the second frame and an opening in the distal end thereof through which the support member of the second frame can enter the cavity, each of the bases of the first and second frames having at least one stowage hole therethrough that is sufficiently large to receive one of the ends of the lifting bar; and means for securing the ends of the lifting bar within a pair of the adjustment holes of the support members while the gripping portion of the lifting bar is between the support members;

wherein the first and second frames and the lifting bar are assemblable to define a deployed configuration of the exercise apparatus in which the support members of the first and second frames are parallel to each other, the ends of the lifting bar are received within a pair of the adjustment holes of the support members, the gripping portion of the lifting bar is between the support members, and the securing means retain the lifting bar within the pair of the adjustment holes; and wherein the first and second frames and the lifting bar are assemblable to define a stowed configuration of the exercise apparatus in which the support member of the second frame is slidably received in the support member of the first frame to define a stowed axis of the exercise apparatus, the stowage holes in the bases of the first and second frames are aligned along an axis parallel to the stowed axis, the ends of the lifting bar are received within the stowage holes in the bases, and the securing means simultaneously retain the lifting bar on the bases and the support member of the second frame within the support member of the first frame.

2. The exercise apparatus according to claim 1, wherein the cavity of the support member of the first frame is sufficiently large to receive more than half of the support member of the second frame.

3. The exercise apparatus according to claim 1, wherein the cavity of the support member of the first frame is sufficiently large to entirely receive the support member of the second frame.

4. The exercise apparatus according to claim 1, wherein the adjustment holes are located closer to the distal ends of the support members than to the bases.

5. The exercise apparatus according to claim 1, wherein the securing means comprises male threads defined on the ends of the lifting bar and fasteners having female threads that are complementary to the male threads of the lifting bar.

6. The exercise apparatus according to claim 1, further comprising weights adapted to be removably mounted on the support members of the first and second frames.

7. The exercise apparatus according to claim 6, wherein each of the weights has a slot sized to receive an entire cross-section of the support member of the first frame.

8. The exercise apparatus according to claim 7, wherein each of the weights has at least one through-hole that is sufficiently large to receive one of the ends of the lifting bar.

9. The exercise apparatus according to claim 8 wherein, with the exercise apparatus is in the stowed configuration and the weights mounted on the support member of the first frame, the through-holes in the weights are coaxially aligned with the stowage holes of the bases, the ends of the lifting bar are received within the through-holes in the weights and the stowage holes in the bases, and the securing means simultaneously retain the ends of the lifting bar within the through-holes of the weights.

10. The exercise apparatus according to claim 1, wherein the first and second frames are interconnected solely through the lifting bar when the exercise apparatus is in the deployed configuration.

11. The exercise apparatus according to claim 1, wherein the support member of each of the first and second frames is a hollow post.

12. The exercise apparatus according to claim 1, wherein the support member of each of the first and second frames has a rectilinear cross-section.

13. The exercise apparatus of claim 1 comprises a package, wherein the exercise apparatus is in the stowed configuration, the support member of the second frame is at least partially received in the support member of the first frame, the stowage holes in the bases of the first and second frames are aligned along the axis parallel to the stowed axis, the ends of the lifting bar are received within the stowage holes, and the securing means simultaneously retain the lifting bar on the bases and the support member of the second frame within the support member of the first frame.

14. The package according to claim 13, wherein the support member of the second frame is entirely received within the cavity of the support member of the first frame.

15. A method of stowing the exercise apparatus of claim 1, the method comprising:

providing the exercise apparatus of claim 1;

inserting the distal end of the support member of the second frame through the opening in the distal end of the support member of the first frame until at least a portion of the support member of the second frame is slidably received in the cavity within the support member of the first frame, the inserting step being performed so that stowage holes in the bases of the first and second frames are co-axially aligned;

placing the lifting bar between the bases of the first and second frames;

inserting the ends of the lifting bar through the stowage holes of the bases; and securing the ends of the lifting bar within the stowage holes.

16. The method according to claim 15, further comprising removably mounting weights on the support member of the first frame following the inserting step so that each of the weights has at least one through-hole that is coaxially aligned with the stowage holes of the bases, wherein the inserting step further comprises inserting the ends of the lifting through the through-holes in the weights, and the securing step further comprises simultaneously retaining the ends of the lifting bar within the through-holes of the weights.

17. A method of stowing an exercise apparatus that comprises a lifting bar having oppositely-disposed ends and a gripping portion therebetween, and first and second frames that each comprise a support member, a base adapted to support the support member in a vertical orientation when the base is on a horizontal surface, and distal ends of the support members that are oppositely disposed from the bases thereof, the method comprising:

inserting the distal end of the support member of the second frame through an opening in the distal end of the support member of the first frame until at least a portion of the support member of the second frame is slidably received in a cavity within the support member of the first frame, the inserting step being performed so that stowage holes in the bases of the first and second frames are co-axially aligned;

placing the lifting bar between the bases of the first and second frames;

inserting the ends of the lifting bar through the stowage holes of the bases; and securing the ends of the lifting bar within the stowage holes.

18. The method according to claim 17, wherein the support member of the second frame is entirely received within the cavity of the support member of the first frame following the securing step.

19. The method according to claim 17, further comprising removably mounting weights on the support member of the first frame following the inserting step.

20. The method according to claim 19, wherein the weights are removably mounted on the support member of the first frame so that each of the weights has at least one through-hole that is coaxially aligned with the stowage holes of the bases, the inserting step further comprises inserting the ends of the lifting bar through the through-holes in the weights, and the securing step further comprises simultaneously retaining the ends of the lifting bar within the through-holes of the weights.

* * * * *